US005294228A

United States Patent [19]

Willis et al.

[11] Patent Number: 5,294,228

[45] Date of Patent: Mar. 15, 1994

[54] AUTOMATIC SEQUENCING SYSTEM FOR EARTH DRILLING MACHINE

[75] Inventors: Clyde A. Willis; Jerry K. Lingafelter, both of Wichita Falls, Tex.

[73] Assignee: W-N Apache Corporation, Wichita Falls, Tex.

[21] Appl. No.: 750,860

[22] Filed: Aug. 28, 1991

[51] Int. Cl.[5] ..... E21B 19/00

[52] U.S. Cl. ..... 414/22.55; 414/22.62

[58] Field of Search ..... 414/22.54, 22.55, 22.62; 166/53; 364/422, 478

[56] References Cited

U.S. PATENT DOCUMENTS

| | | | |
|---|---|---|---|
| 1,417,096 | 5/1922 | Mueller . | |
| 2,999,605 | 9/1961 | De Jarnett . | |
| 3,054,514 | 9/1962 | Riley . | |
| 3,194,313 | 7/1965 | Fanshawe | 414/22.55 X |
| 3,501,027 | 3/1970 | Dea et al. | 414/22.54 X |
| 3,515,289 | 10/1968 | Schaller et al. . | |
| 3,630,392 | 12/1971 | Cintract . | |
| 3,682,259 | 8/1972 | Cintract et al. | 414/22.55 X |
| 4,067,453 | 1/1978 | Moller . | |
| 4,604,724 | 8/1986 | Shaginian et al. | 414/22.55 X |

FOREIGN PATENT DOCUMENTS 2721342 11/1978 Fed. Rep. of Germany .

OTHER PUBLICATIONS

"Development of Automated Offshore Drilling System" by H. Fujita, M. Sato and N. Shiraishi, Mitsu Engineering & Shipbuilding Co. Ltd.; Y. Wakiya, Japan Ocean Industries Assns.; and S. Tanaka, U. of Tokyo, Copyright 1990, Offshore Technology Conference, presented at the 22nd Annual OTC in Houston, Texas, May 7-10, 1990.

"The Howden Hustler" pp. 11-15 (undated).

"APACHE Remote Controlled Semi, or Fully Automated Top Head Drive On Land 7 Offshore Oil & Gas Well Drilling Machines", W-N Apache Corporation, Wichita Falls, Texas 76307, Catalog No. 188.

"Rig-Automated Drilling: A New Concept is Being Proven", S. J. Houston, Strachan & Henshaw Ltd., Copright 1991, Offshore Technology Conference, presented at the 23rd Annual OTC in Houston, Texas May 6-9, 1991.

*Primary Examiner*—D. Glenn Dayoan
*Assistant Examiner*—Boris Milef
*Attorney, Agent, or Firm*—Willian Brinks Hofer Gilson & Lione

[57] ABSTRACT

An earth drilling machine of the type having a boom mounted adjacent a mast to move a tubular between a lower, horizontal boom position and an upper, vertical boom position also includes a lifter configured to move a length of downhole tubular between a lower lifter position aligned with a tubular storage device and an upper lifter position aligned with the lower boom position. An automatic sequencing system includes multiple position sensors responsive to the position of at least the boom, the lifter and a length of downhole tubular at selected positions. A sequencing system is responsive to the position sensors for automatically coordinating movement of the lifter and the boom to reduce or eliminate delays occasioned by tubular handling.

5 Claims, 11 Drawing Sheets

AUTOMATIC SEQUENCING SYSTEM FOR EARTH DRILLING MACHINE

BACKGROUND OF THE INVENTION

This invention relates to earth drilling machines of the type having a mast, a drive, assembly movable along the mast, a boom mounted adjacent the mast to move between a lower boom position and an upper boom position, a plurality of boom clamps mounted to the boom to grip a length of down hole tubular, a tubular storage device at a lower level, and a lifter configured to move a length of down hole tubular between a lower lifter position aligned with the tubular storage device and an upper lifter position aligned with the lower boom position. In particular, this invention relates to an automatic sequencing system for such an earth drilling machine that automatically coordinates movements of the boom and the lifter.

As used herein the term "down hole tubular" is intended broadly to cover the full range of tubulars used in earth drilling and production operations, including drill pipes, casings, and production tubulars.

In the past, earth drilling machines of the type described above have been manually controlled to raise a tubular from the storage device via the lifter and the boom to the center line of the bore hole drilled by the drilling machine. Similarly, simple manual control has been used when lowering a tubular off of the bore hole axis and down to the storage device with the boom and the lifter.

Manual control of this type can be taxing on the operator, and operator mistakes can result in damage to the drilling equipment. Furthermore, it is difficult or even impossible for an operator to coordinate movement of the boom and the lifting device in a consistent manner so as to minimize the time required to transfer a tubular between the storage device and the center line of the bore hole.

An earth drilling machine of the type described above may in certain cases not be provided with an explosion proof electrical system in the vicinity of the bore hole. In such cases, the use of electrically powered sensors or actuators can result in explosion proof electric system can be avoided to the a considerable expense. The expense of such an extent that mechanically operated valves and sensors can be substituted for electrically operated valves and sensors. As used herein, the term "mechanically operated" is intended broadly to encompass lever actuation, cam actuation and hydraulic pilot pressure actuation.

SUMMARY OF THE INVENTION

According to a first aspect of this invention, an earth drilling machine of the type described initially above is provided with an automatic sequencing system that comprises a plurality of position sensors responsive to position of at least the boom, the lifter, and a length of down hole tubular at selected positions. Means, responsive to the position sensors, are provided for automatically coordinating movement of the lifter and the boom such that the boom raises a first tubular from the lower to the upper boom positions and the lifter raises a second tubular from the lower to the upper lifter positions. The boom and lifter are controlled such that movement of the boom overlaps movement of the lifter. Preferably, the boom and lifter are controlled such that upward movement of the first tubular in the boom overlaps upward movement of the second tubular in the lifter. Preferably, the position sensors are mechanically operated, and the control means comprises mechanically controlled hydraulic valves operative to coordinate movement of the boom and the lifter.

According to a second aspect of this invention, an earth drilling machine of the type described initially above is provided with an automatic sequencing system comprising a plurality of position sensors responsive to position of at least the boom, the lifter, and a length of down hole tubular at selected positions. Means, responsive to the position sensors, are provided for automatically coordinating movement of the lifter and the boom such that the boom lowers the first tubular from the upper to lower boom positions and the lifter lowers a second tubular from the upper to the lower lifter positions. The boom and lifter are controlled such that movement of the boom overlaps movement of the lifter. Preferably, the position sensors are mechanically operated, and the control means comprises mechanically controlled hydraulic valves operative to coordinate movement of the boom and the lifter.

The preferred embodiment described below provides a number of important advantages. The sequencing system operates automatically, thereby providing high speed handling of the tubulars. Because operation of the lifter is automatically coordinated with operation of the boom, pipe handling delays are reduced or eliminated. Safety is improved as compared with manual operation because the predetermined sequence provided by the automatic sequencer eliminates many opportunities for human error. The system described below uses mechanically operated sensors and valves and thereby eliminates the need for an explosion proof electrical system. This is particularly advantageous for many smaller earth drilling machines which may not have suitable explosion proof electrical systems. Furthermore, mechanical sensors and valves are technologically simple, and they can be serviced by individuals without specialized electronics training.

The invention itself, together with further objects and attendant advantages, will best be understood by reference to the following detailed description taken in conjunction with the accompanying drawings.

DETAILED DESCRIPTION OF THE DRAWINGS

Figure 3:
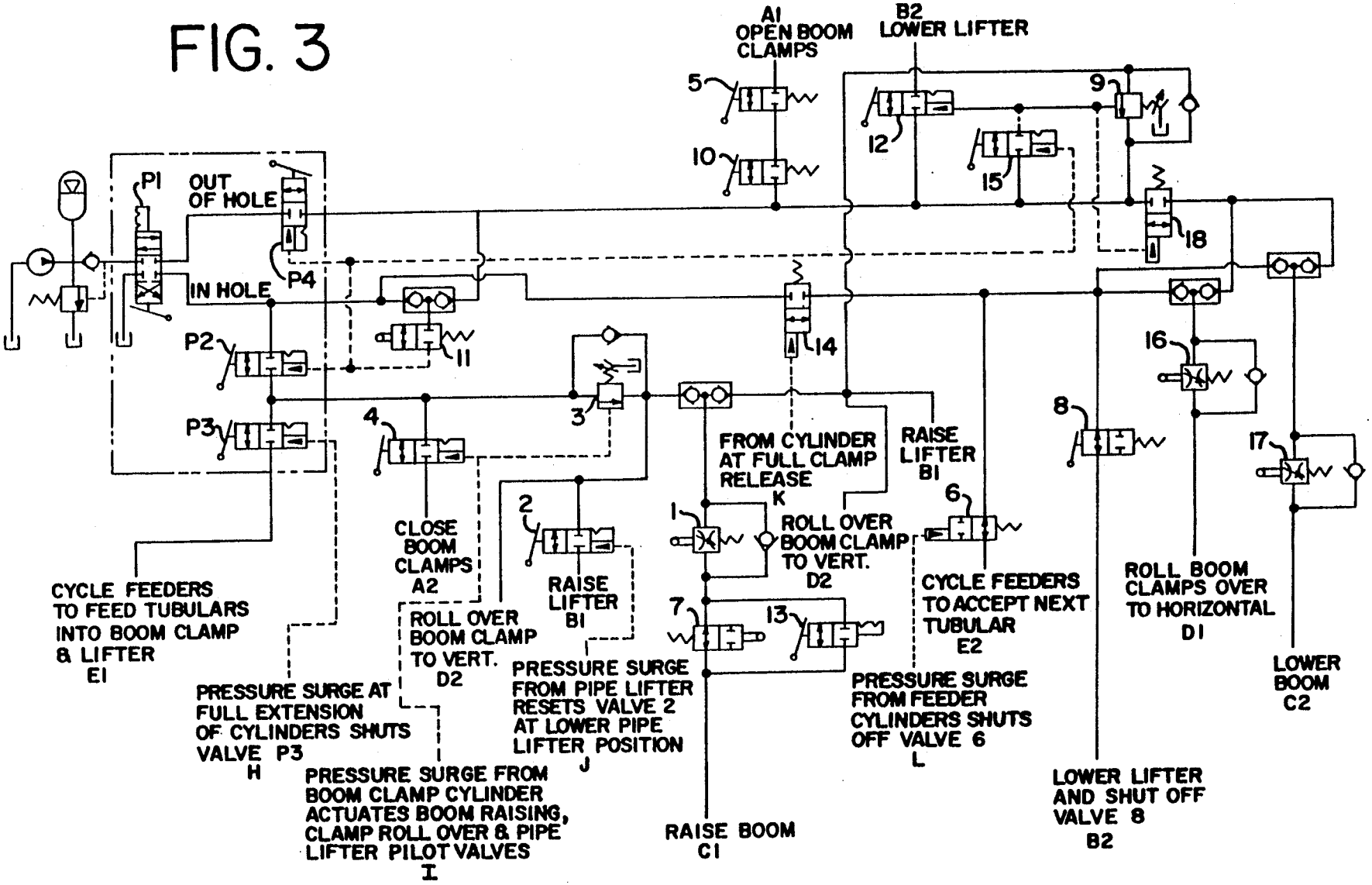
FIG. 3 is a hydraulic schematic diagram of the automatic sequencing system included in the drilling machine of FIGS. 1 and 2.
Figure 4A:
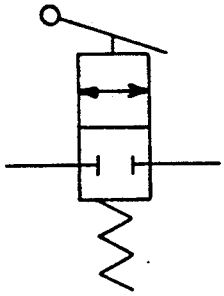
Figure 4B:
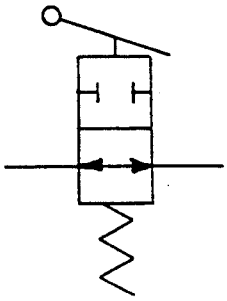
Figure 4C:
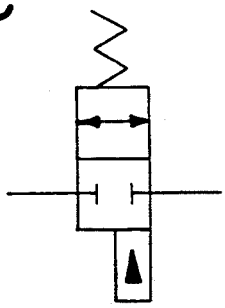
Figure 4D:
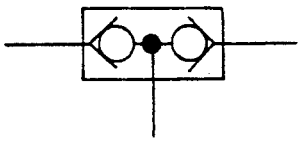
Figure 4E:
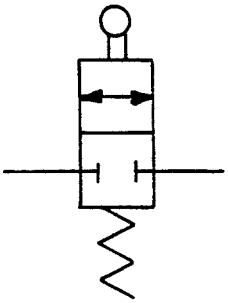
Figure 4F:
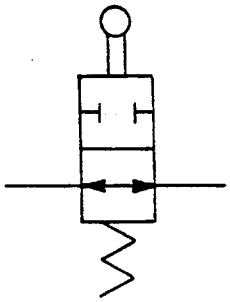
Figure 4G:
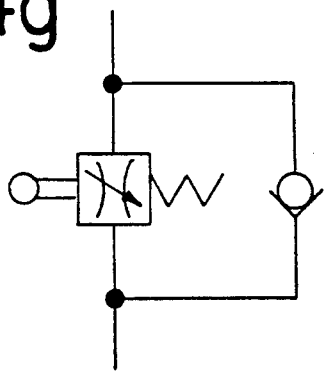
Figure 4H:
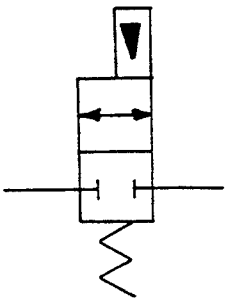
Figure 4I:
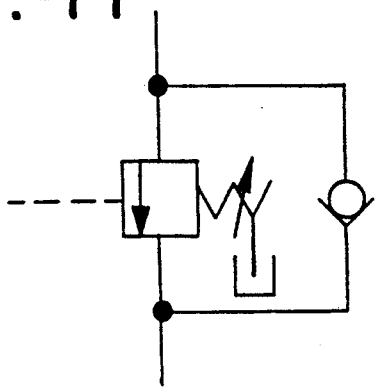
Figure 4M:
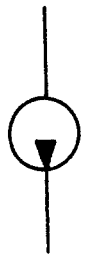
Figure 4J:
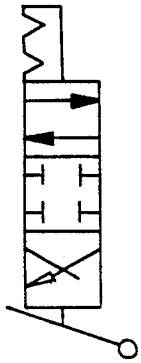
Figure 4N:
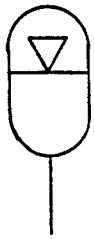
Figure 4K:
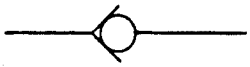
Figure 4O:
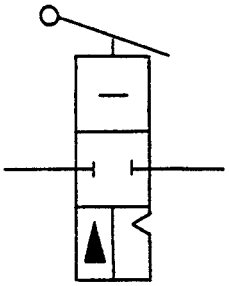
Figure 4L:
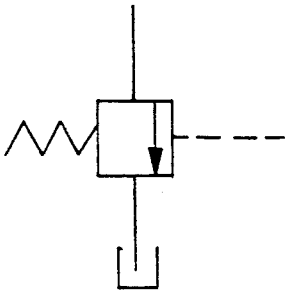
Figure 4P:
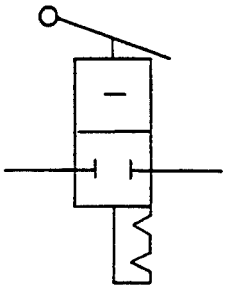

FIGS. 4*a* through 4*p* are schematic diagrams of the valves used in the schematic diagram of FIG. 3.

Figure 5:
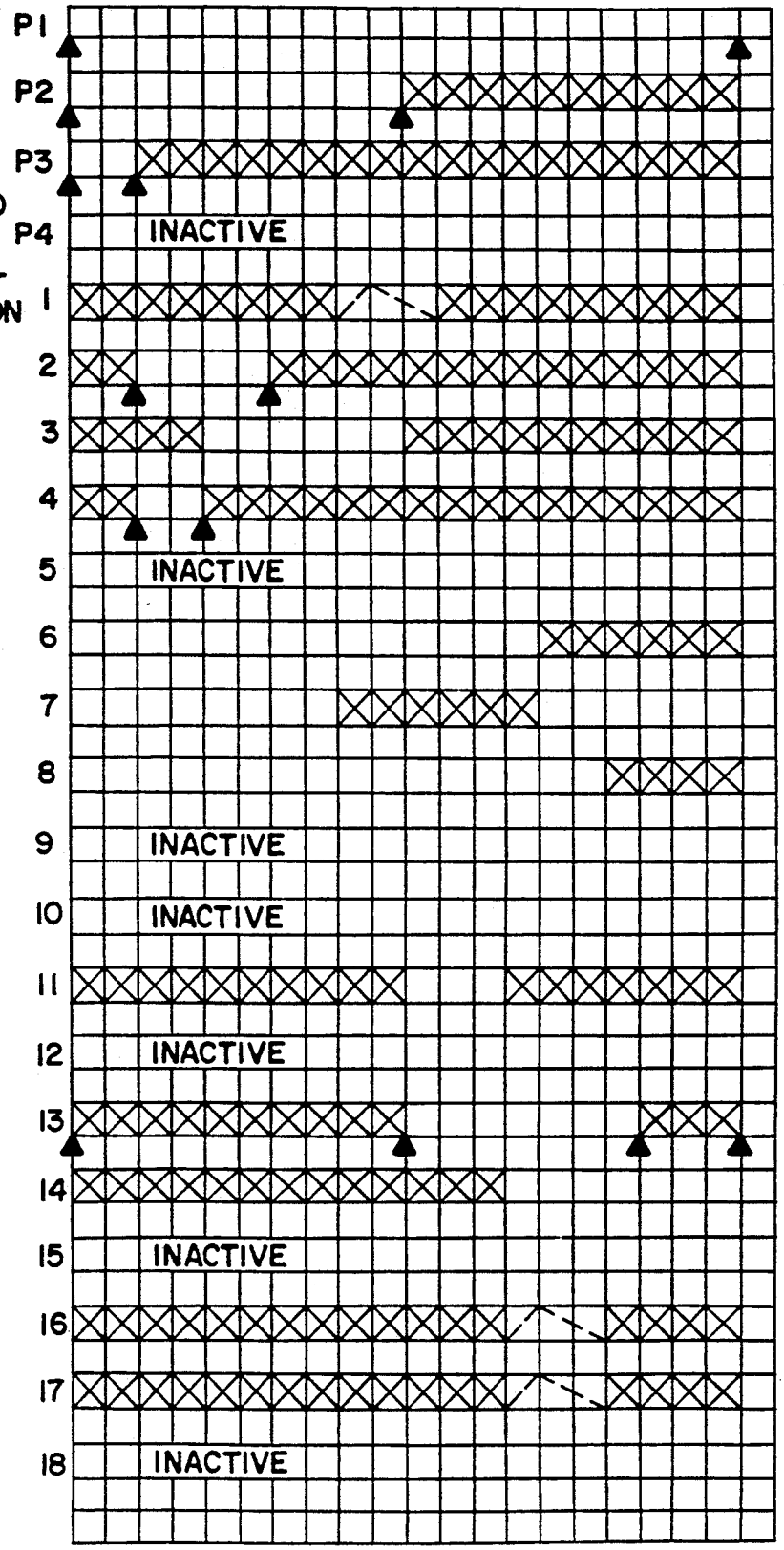

FIG. 5 is a chart showing the operation of the various valves of the schematic diagram of FIG. 3 as the automatic sequencer is used to move a drilling tubular from the storage device to the bore hole axis.

Figure 6:
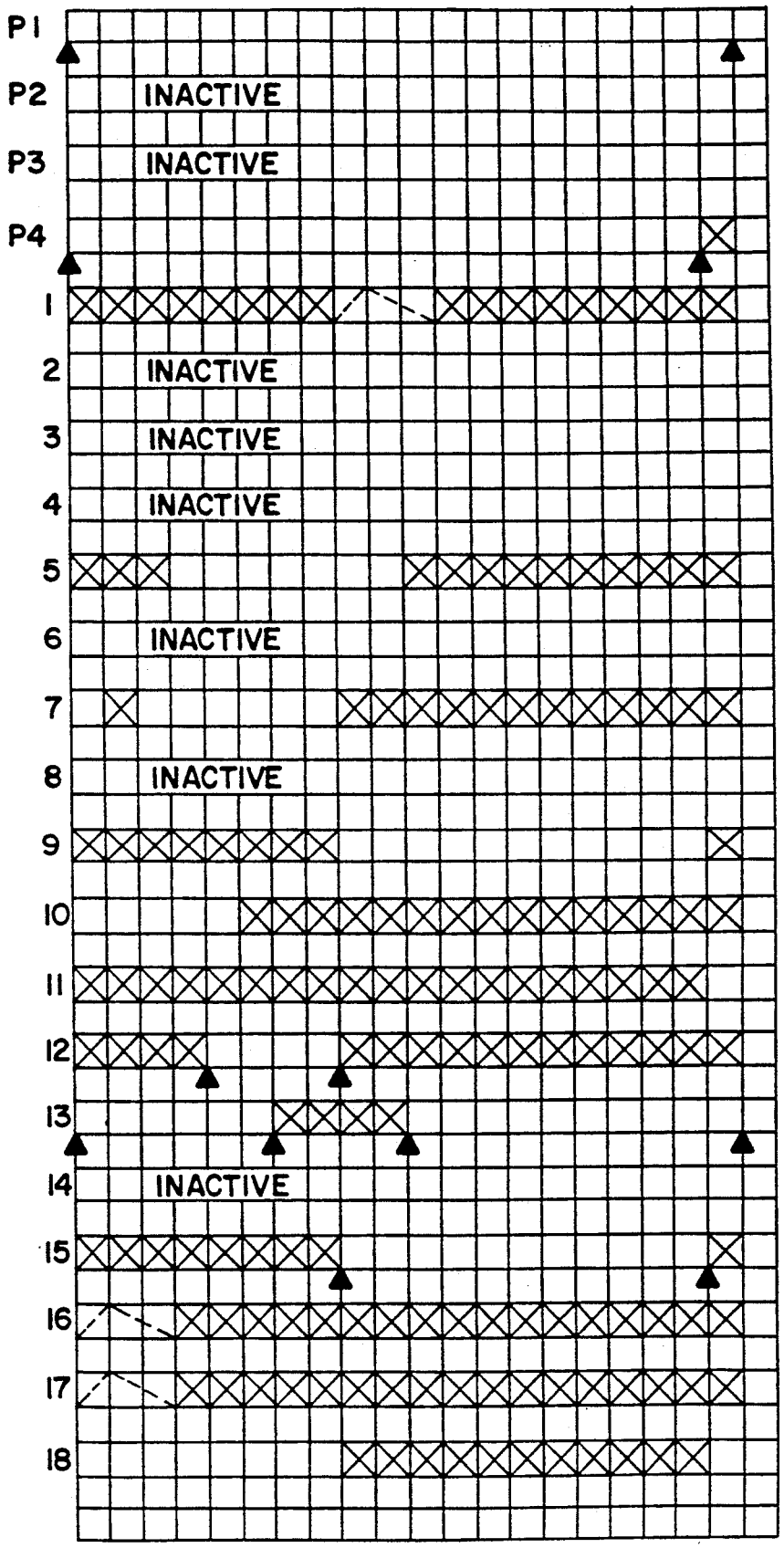

FIG. 6 is a chart showing operation of the various valves of FIG. 3 as the automatic sequencer is used to move a length of down hole tubular from the bore hole axis to the storage device.

Figure 7:
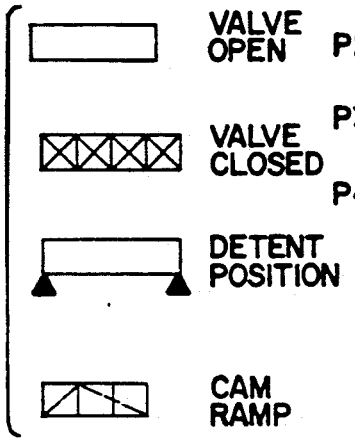

FIG. 7 is a legend for the charts of FIGS. 5 and 6.

Figure 1:
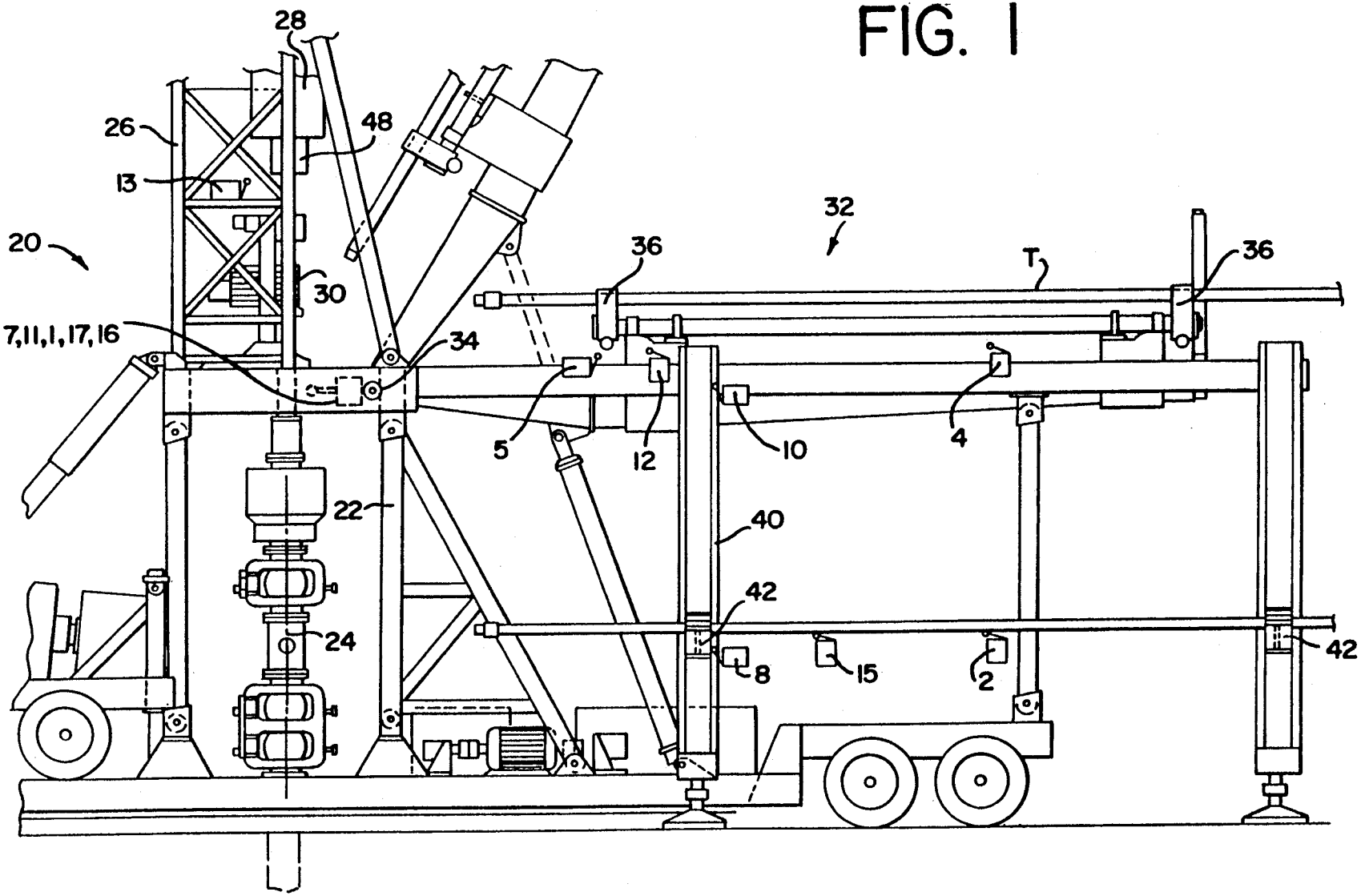
FIG. 1 is a side elevational view of an earth drilling machine which incorporates a presently preferred embodiment of this invention.
Figure 2:
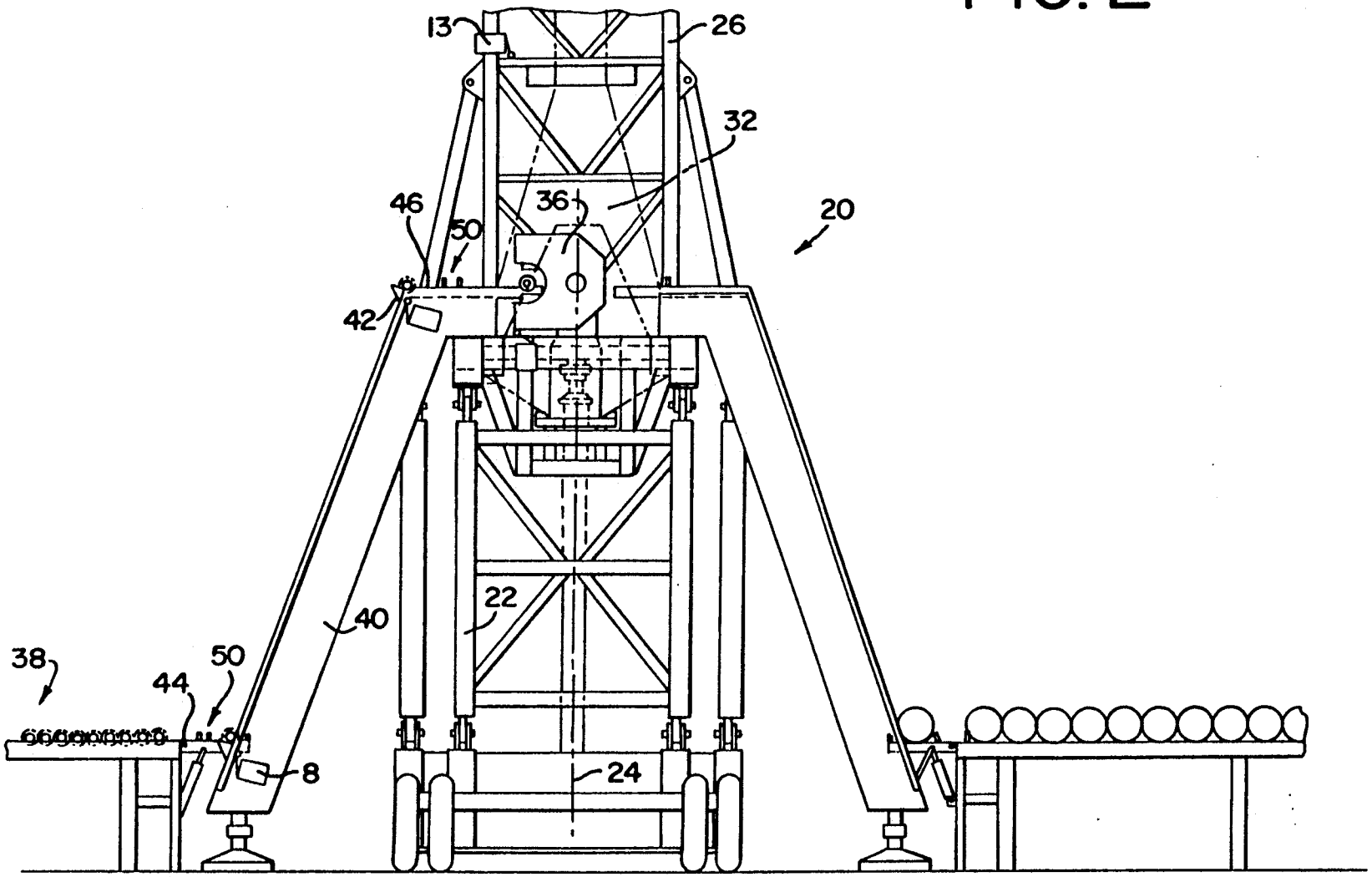
FIG. 2 is an end elevational view of the drilling machine of FIG. 1.
Figure 8:
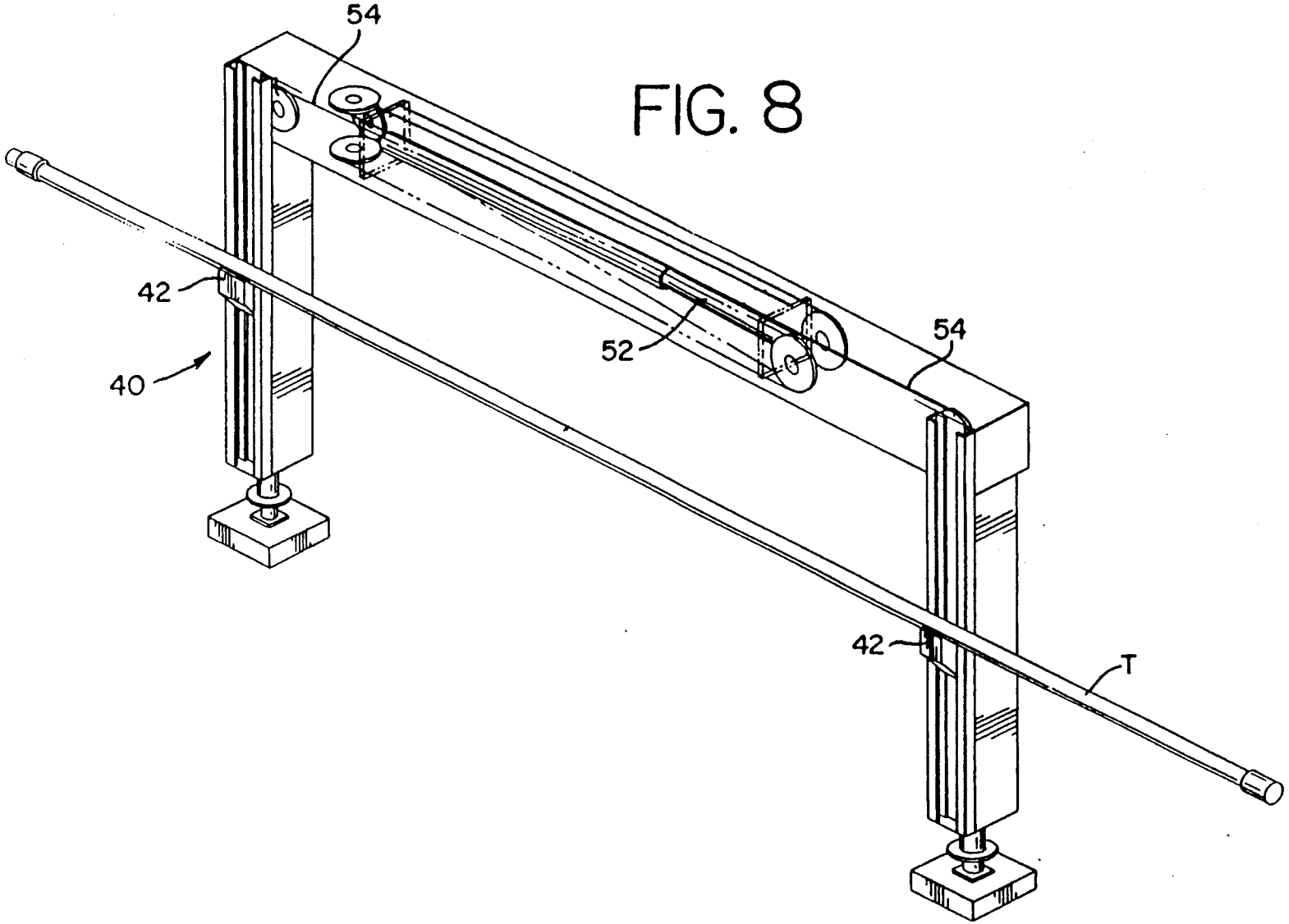

FIG. 8 is a partially schematic view of the lifter 40 of FIGS. 1 and 2.

FIGS. 9–14 are six side elevation views of one of the feeders 50 of FIG. 2 at various stages of the feeder cycle.

DETAILED DESCRIPTION OF THE PRESENTLY PREFERRED EMBODIMENTS

Turning now to FIGS. 1 and 2, the presently preferred embodiment of the automatic sequencing system of this invention is adapted for use with the drilling machine 20 having a substructure 22 centered on a bore hole axis 24. A mast 26 is mounted to extend upwardly from the substructure 22, and the mast 26 guides a top head drive assembly 28 in vertical movement. The top head drive assembly 28 is provided with a tool 48 for engaging and releasing a length of downhole tubular and for rotating the tubular to assist in make up and break out operations.

A make-up/break-out wrench 30 is mounted in alignment with the bore hole axis 24 directly over a set of conventional slips (not shown), and a boom 32 is mounted for pivotal movement about a horizontal axis 34. The boom 32 is shown in solid lines in FIG. 1 in the lower boom position in which the boom 32 extends substantially horizontally. Dashed lines are used in FIG. 2 to show the boom 32 in a partially elevated position. When the boom 32 is fully raised to the upper, vertical position, a tubular T held in the boom 32 is aligned with the bore hole axis 24.

The boom 32 has mounted on it two boom clamps 36 which are mounted for rotation about an axis extending along the length of the boom 32. The boom clamps 36 are shown in FIG. 2 in the horizontal position, in which the opening to the clamps 36 is positioned to one side to receive or to discharge a tubular T. Hydraulic cylinders (not shown) are provided for rotating the boom clamps from the horizontal position of FIG. 2 to the vertical position of FIG. 1.

As shown in FIGS. 1 and 2, tubular storage devices 38 are provided near ground level for storing downhole tubulars in a substantially horizontal position near ground level. Lifters 40 are provided with movable dolleys 42 for raising and lowering tubulars T between a lower lifter position aligned with the storage devices 38 and an upper lifter position aligned with the boom clamps 36.

Two transfer shoulders or ramps 44, 46 are provided. The lower ramp 44 is positioned between the storage device 38 and the lifter 40, and the upper ramp 46 is positioned between the lifter 40 and the boom clamps 36. The ramps 44, 46 can be adjusted in tilt angle such that a tubular resting on the ramps 44, 46 will roll by force of gravity either toward or away from the lifter 40.

Each of the ramps 44, 46 is provided with a feeder 50 which controls the flow of tubulars toward and away from the lifter 40. As described below in conjunction with FIGS. 9–14, the preferred feeder 50 includes two vertically oriented fingers which can be cycled with a hydraulic cylinder. The cycle includes a tubular receiving cycle (in which a first finger is lowered to allow a tubular to roll into contact with the second finger) and a tubular dispensing cycle (in which the first finger is raised and the second finger is lowered to allow the tubular to roll out of the feeder).

The features described above of the drilling machine 20 are conventional and have been described to define the environment of the present invention. Issued patents and pending applications assigned to the assignee of the present invention disclose suitable prior art structures. For example, the mast and the top head drive assembly 26, 28 may be as shown in U.S. Pat. Nos. 4,314,611, 4,708,581, or 4,821,814. The top head drive assembly shown in U.S. Pat. No. 4,821,814 is presently preferred. The boom 32 may be of the type described in U.S. Pat. No. 4,407,629, and the rotatably mounted boom clamps may be of the type described in U.S Pat. Nos. 4,475,607 and 4,366,606. The tool 48 may be of the type described in U.S. Pat. No. 5,036,927 and the makeup/break out wrench 30 may be of the type described in U.S. Pat. No. 4,403,666. The storage device 38 may be a rack as described in U.S. Pat. No. 4,533,055, and the lifter 40 and feeder 50 may be as described in U.S. patent applications Ser. No. 07/730,551 and 07/731,077, respectively. Each of these documents is hereby incorporated by reference for its description of the respective component of the drilling machine 20.

FIG. 8 shows a somewhat schematic view of the lifter 40 taken from U.S. patent application Ser. No. 07/730,551. As shown in FIG. 8, the dolleys 42 are coupled by cables 54 to a hydraulic cylinder 52. Extension of the cylinder 52 lifts the dolleys 42 in a coordinated manner. Similarly, retraction of the cylinder 52 lowers the dolleys 42.

Figure 9:
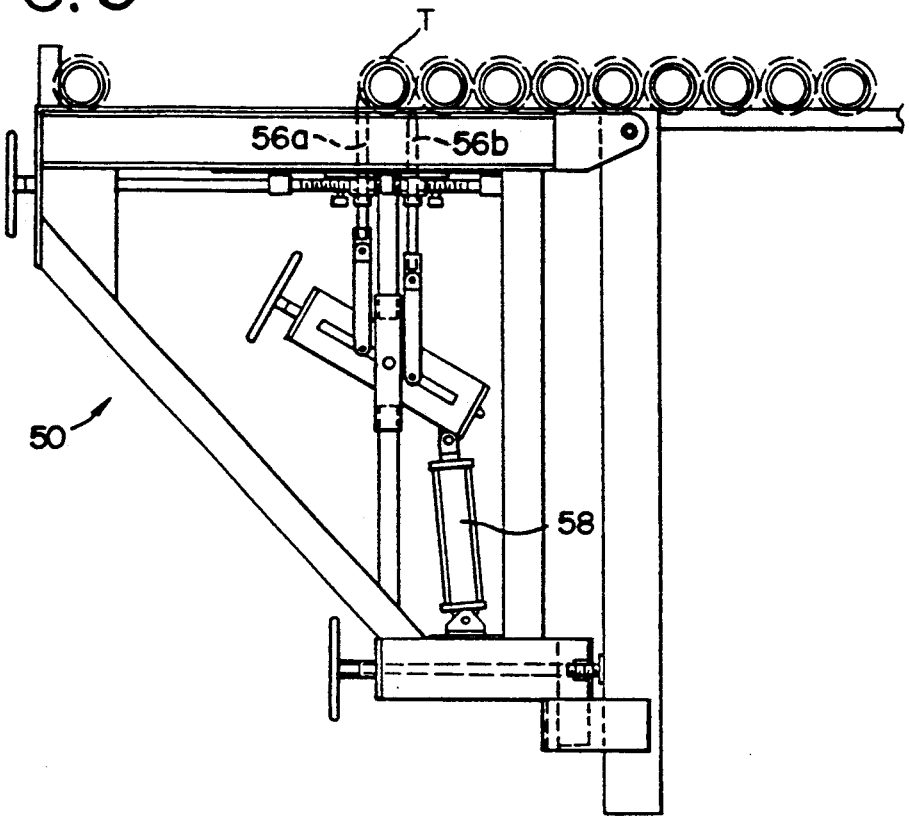
Figure 10:
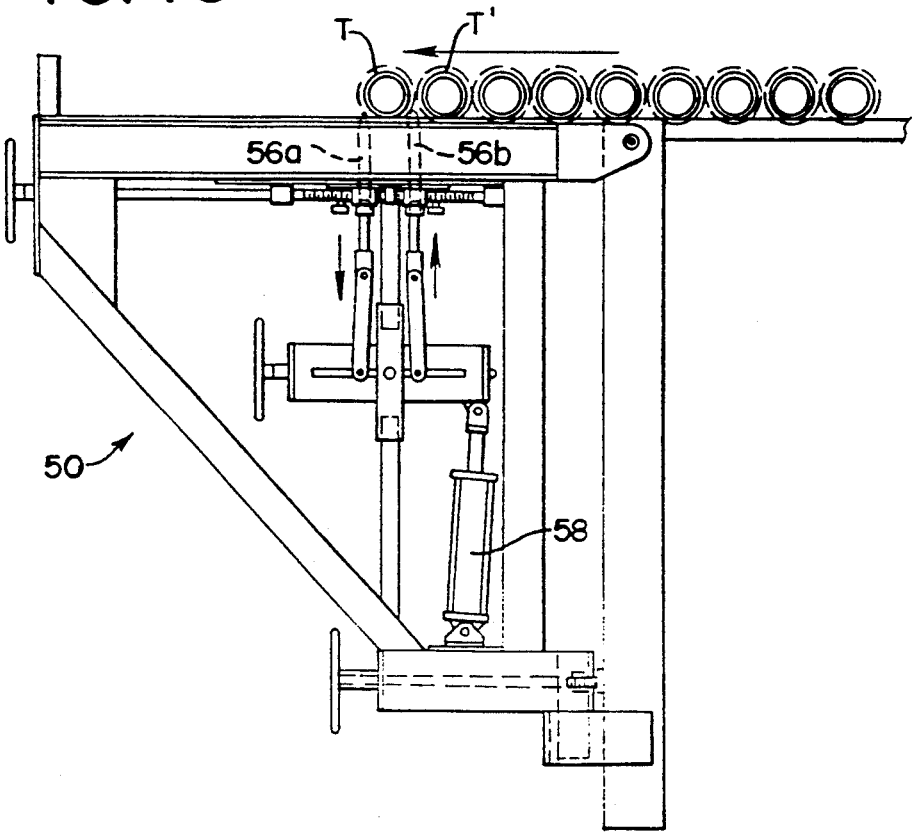
Figure 11:
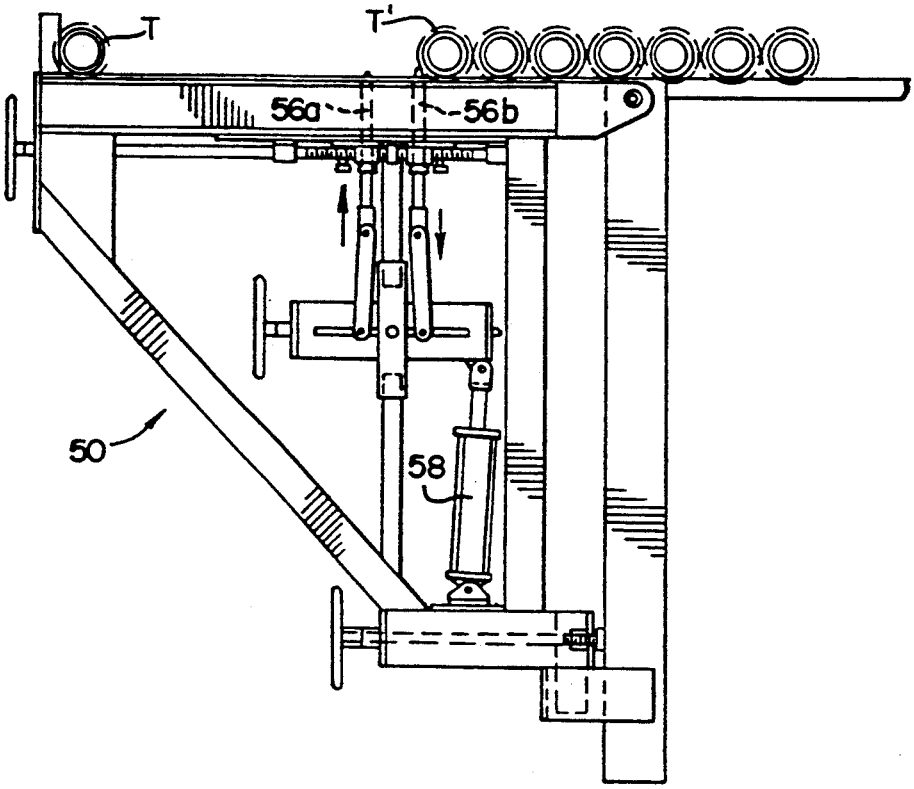
Figure 12:
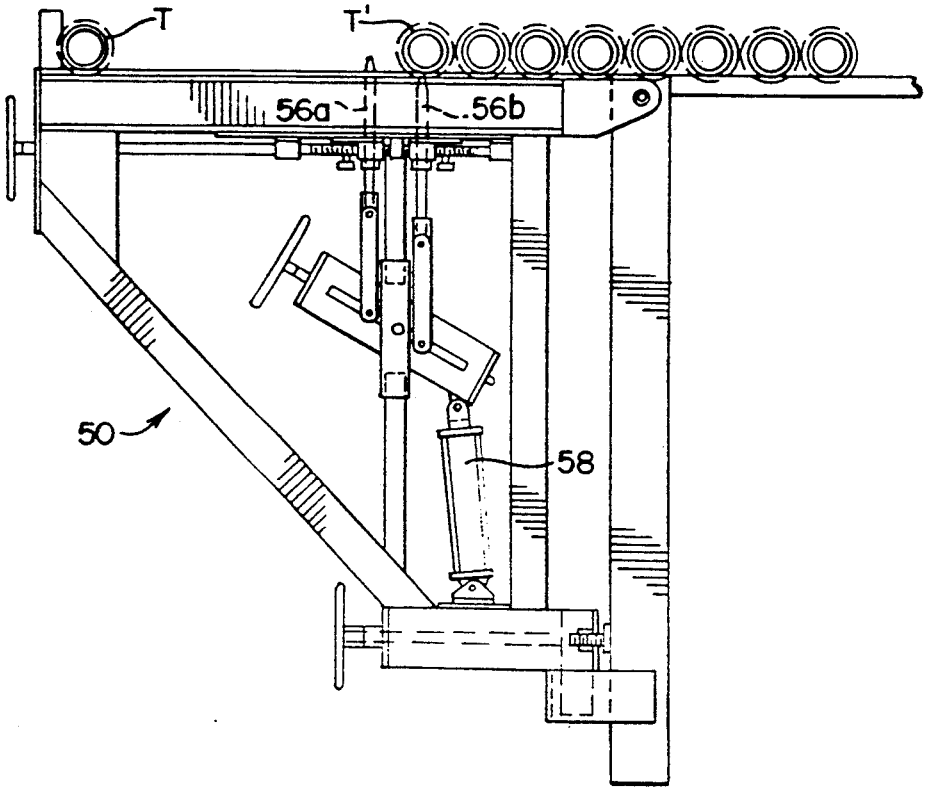
Figure 13:
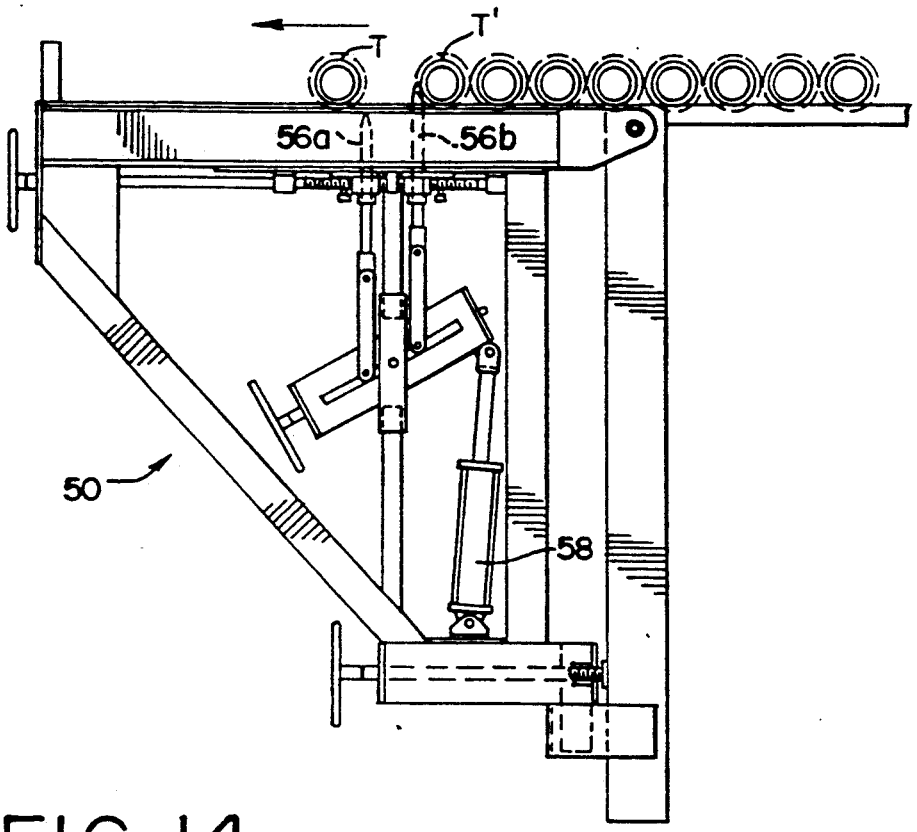
Figure 14:
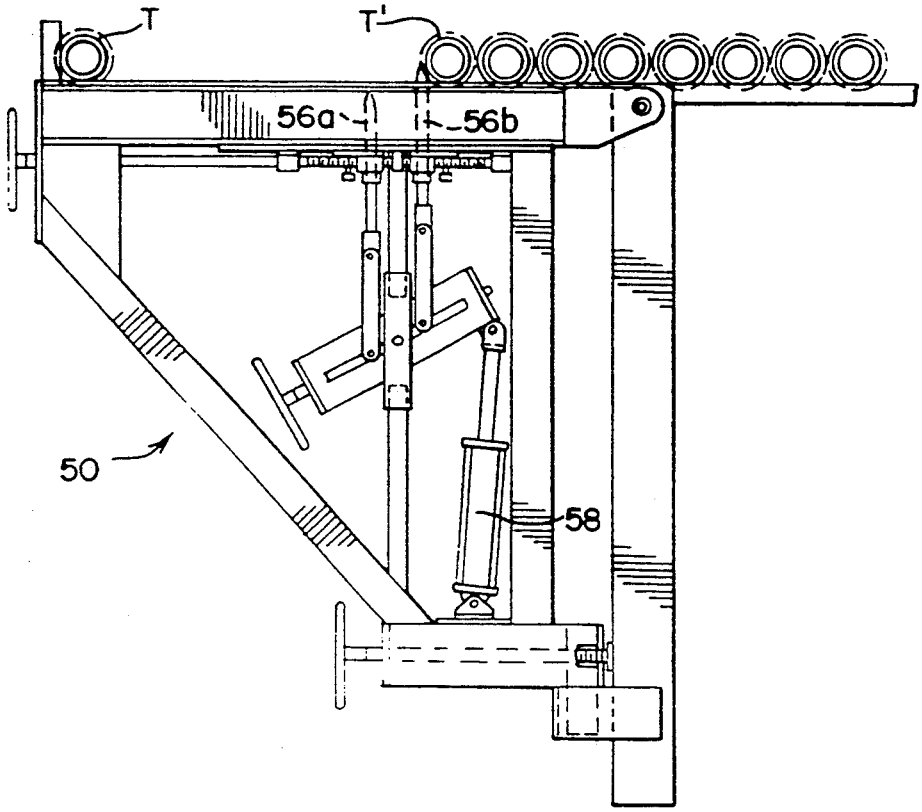

FIGS. 9–13 are taken from U.S. Pat. application Ser. No. 07/731,077, and they illustrate operation of the feeders 50. (In FIGS. 9–13, the feeder 50 is reversed left to right as compared to the orientation of FIG. 2.) The fingers 56*a*, 56*b* are moved in opposition by a hydraulic cylinder 58. FIGS. 9–11 show the dispensing cycle: extension of the cylinder 58 lowers the finger 56*a*, raises the finger 56*b*, and dispenses the tubular T. FIGS. 12–14 show the receiving cycle: retraction of the cylinder 58 lowers the finger 56*b*, raises the finger 56*a*, and receives a next tubular T into position for dispensing.

The drilling machine 20 also includes the presently preferred embodiment 60 of the automatic sequencing system of this invention. This sequencing system 60 includes four manually operated valves P1–P4 and 18 mechanically operated valves 1–18. As mentioned above, the term mechanically operated valve is intended broadly to encompass lever operated, cam operated and hydraulically operated valves.

FIGS. 1 and 2 show the preferred placement of the mechanically operated valves that are responsive to the position of tubulars and components of the drilling machine 20. The automatically operated valves 1–18 are described in Table 1, and the manually operated valves are described in Table 2.

TABLE 1

Automatically Operated Valves

| Valve | Action |
|---|---|
| 1 | Progressively opened and closed in response to position of boom to control speed of boom as it is raised (low speed near horizontal and hold positions, higher speed at intermediate boom angles) |
| 2 | Opened when a tubular is in position at lower lifter position to be picked up by lifter (detented) |
| 3 | Opened when boom clamps, shown in FIG. 2, reach fully clamped (closed) position |
| 4 | Opened when a tubular is in position ready to be clamped by boom clamps (detented) |
| 5 | Opened when boom is in horizontal position and boom clamps are rotated to horizontal |

TABLE 1-continued

| Valve | Automatically Operated Valves<br>Action |
|---|---|
| | position, as shown in FIG. 2 |
| 6 | Closed by pressure surge from feeder cylinder |
| 7 | Closed when boom reaches hold position (75° from horizontal) |
| 8 | Closed when lifter reaches lower position |
| 9 | Opened when valve 15 opens |
| 10 | Opened when lifter reaches upper position |
| 11 | Opened when boom reaches vertical position (90° from horizontal) |
| 12 | Opened when a tubular is in lifter at upper lifter position (detented) |
| 13 | Opened when top head drive moves into selected upper portion of mast (detented) |
| 14 | Opened when boom clamps are fully opened |
| 15 | Opened when tubular leaves lifter at lower lifter position (detented) |
| 16 | Progressively opened and closed in response to position of boom to control rolling of boom clamps to horizontal (starting at 75° from horizontal as boom is lowered) |
| 17 | Progressively opened and closed in response to position of boom to decelerate boom as it approaches horizontal position (starting at 20° from horizontal) |
| 18 | Opened when valve 15 opens |

TABLE 2

| Valve | MANUALLY OPERATED VALVES<br>Action |
|---|---|
| P1 | Driller selects sequence (moving tubulars into the hole or out of the hole), (detented, manually operated) |
| P2 | Driller starts sequence moving tubulars into the hole (detented, manually operated) |
| P3 | Driller starts sequence moving tubulars into the hole (detented, manually operated) |
| P4 | Driller starts sequence moving tubulars out of the hole (detented, manually operated) |

The automatically operated valves 1, 7, 11, 16 and 17 are controlled by respective cams (not shown) mounted to move with the boom 32. Thus, these valves are responsive to boom position. Valve 5 is responsive to boom position, as set out in Table 1. The valves 8 and 10 are responsive to the position of the lifter 40, and the valves 4, 12, 2 and 15 are responsive to the presence or absence of a downhole tubular at respective positions.

FIG. 3 is a hydraulic schematic diagram of the sequencing system 60, showing the manner in which the manually operated valves P1–P4 and the mechanically operated valves 1–18 are arranged. The symbols used for the valves P1–P4 and 1–18 in FIG. 3 are shown in FIGS. 4*a* through 4*p* and defined in Table 5. The schematic diagram of FIG. 3 shows pilot pressure control outputs A1–E2 which are defined in Table 3. The schematic diagram of FIG. 3 also shows pilot pressure control inputs H–L which are defined in Table 4. The pilot pressure control outputs of Table 3 are relatively low pressure hydraulic signals which are applied as pilot pressure signals to control clamping and unclamping of the boom clamps (A1, A2) raising and lowering of the lifter 40 (B1, B2), raising and lowering of the boom 32 (C1, C2), rotating the boom clamps to the horizontal and the vertical positions (D1, D2), and cycling the feeders 50 to dispense and receive tubulars (E1, E2). The pilot pressure control inputs of Table 4 provide pressurized fluid as a control pilot pressure when the cylinders of the feeders 50 are fully extended (H), when the boom clamps are fully clamped (I), when the lifter is rising from its lower position (J), when the boom clamps 36 are fully opened (K), and when the cylinders of the feeders 50 are fully retracted (L).

TABLE 3

| Reference Symbol | Pilot Pressure Control Outputs<br>System to Which Output Applied | Action Produced When Pilot Pressure High |
|---|---|---|
| A1 | Boom clamps | Open boom clamps |
| A2 | Boom clamps | Close boom clamps |
| B1 | Lifter | Raise lifter |
| B2 | Lifter | Lower lifter |
| C1 | Boom | Raise Boom |
| C2 | Boom | Lower Boom |
| D1 | Boom clamps | Rotate clamps to horizontal |
| D2 | Boom clamps | Rotate clamps to vertical |
| E1 | Feeders | Cycle feeders to dispense tubulars |
| E2 | Feeders | Cycle feeders to receive tubulars |

TABLE 4

| Reference Symbol | Pilot Pressure Control Inputs<br>System From Which Input Originates | State of Originating System That Causes High Pilot Pressure |
|---|---|---|
| H | Feeders | Feeder cylinders fully extended (dispensing cycle completed) |
| I | Boom clamps | Boom clamps fully clamped |
| J | Lifter | Lifter rising from lower position |
| K | Boom clamps | Boom clamps fully opened |
| L | Feeders | Feeder cylinders fully retracted (receiving cycle completed) |

TABLE 5

| FIG. | Valve Symbol Descriptions<br>Description |
|---|---|
| 4a | 2 Way - 2 position, lever operated, normally closed with spring return to normal position |
| 4b | 2 Way - 2 position, lever operated, normally open with spring return to normal position |
| 4c | 2 Way - 2 position, pilot operated, normally open with spring return to normal position |
| 4d | Shuttle valve |
| 4e | 2 Way - 2 position, cam operated, normally closed valve with spring return to normal position |
| 4f | 2 Way - 2 position, cam operated, normally open valve with spring return to normal position |
| 4g | Cam operated variable flow control valve with reverse free flow |
| 4h | 2 Way - 2 position, normally closed, pilot operated with spring return to normal position |
| 4i | Sequence valve |
| 4j | 4 Way - 3 position valve manually operated, detented |
| 4k | Check valve |
| 4l | Unloader valve |
| 4m | Fixed displacement pump |
| 4n | Accumulator - gas charged |

TABLE 5-continued

| FIG. | Valve Symbol Descriptions Description |
|---|---|
| 4o | 2 Way - 2 position, valve, lever operated normally closed with detente and pilot return to normal position |
| 4p | 2 Way - 2 position, valve, lever operated, detented in two positions |

The valves shown in FIGS. 1 and 2 include mechanical sensors that control the valves in response to the measured position of a component of the drilling machine 20 or a tubular T. The hydraulic circuit schematically shown in FIG. 3 automatically controls raising and lowering of the boom 32, clamping and rotation of the boom clamps 36, raising and lowering of the lifter 40 and cycling of the feeders 50 such that all are coordinated to transfer tubulars smoothly into and out of alignment with the bore hole axis 24.

Operation

The following sections define two automatic sequences provided by the system 60. The first automatically transfers tubulars T from the storage device 38 into an upper vertical position in which the tubular is aligned with the bore hole axis 28, and is suitable for tripping in operations. The second automatic sequence lowers a tubular from an initial position in alignment with the bore hole axis 24 to a final position in the storage device 38, and is suitable for tripping out operations.

Automatic Sequence For Moving Tubulars Into Alignment With The Bore Hole Axis (Tripping In)

In order for the drilling machine 20 to be used in this mode of operation the drilling machine 20 is first placed in the following state. The boom 32 is placed in the lower position shown in solid lines in FIG. 1 with the jaws of the boom clamp 36 open, and the boom clamp 36 rotated to the horizontal position as shown in FIG. 2. The upper and lower feeders 50 are operational and adjusted for the size of the tubular being handled. The lifter 40 is in the lower lifter position ready to accept a tubular from the lower feeder 50. The storage devices 38 and the lower and upper ramps 44, 46 are tilted towards the boom 32. Both upper and lower feeders 50 are loaded, ready to dispense a tubular into the lifter 40 and the boom 32, respectively.

In order to initiate the automatic sequence the operator shifts the selector valve P1 upwardly as shown in FIG. 3, thereby selecting the sequence that moves tubulars into alignment with the bore hole axis 24. The operator then shifts valves P2 and P3 to extend the hydraulic cylinders of the feeders 50, causing tubulars to be dispensed by the feeders 50 to the lifter 40 and the boom 32.

As these two tubulars simultaneously roll into position, they open valves 2 and 4 at the lower and upper loading positions. Actuation of valves 2 and 4 causes the boom clamps 36 to clamp. When the boom clamps 36 are fully clamped as indicated by the pressure in the clamp circuit, valve 3 opens causing the boom clamps 36 to roll over from the horizontal to the vertical position, the lifter 40 to begin to raise a first tubular, and the boom 32 to begin to raise a second tubular. The same pressure signal resets valve 4 to its normally closed position and shuts off the control pilot pressure to the boom clamp 36 control circuit. The boom 32 begins to raise the second tubular at a slow speed as dictated by the valve 1 and the associated cam (not shown) at the boom axis 34.

The boom 32 rises to the hold position (approximately 15 degrees short of vertical) and is stopped in that position by valve 7 activated by the respective cam (not shown) at the boom axis 34. If the top head drive assembly 28 is hoisted high enough to clear the boom 32, a bypass valve 13 is opened and allows the boom 32 to continue to the vertical position. If the top head drive assembly 28 is not positioned high enough in the mast 26, the boom 32 pauses at the hold position and waits until the bypass valve 13 opens before proceeding to the vertical position. When the boom 32 reaches the vertical position, the valve 11 opens, thereby resetting the valve P2 and shutting off the pilot signal, interrupting the automatic sequence.

At this point the operator utilizes conventional controls (not shown) to lower the top head drive assembly 28, and close the tool 48 on the tool joint of the tubular held by the boom 32. The operator then releases the boom clamps 36 after the tool 48 is securely attached to the tubular in the boom 32. As the boom clamp cylinder is fully retracted, a signal is sent to valve 14 causing it to open and causing the automatic sequence to resume. The opening of the valve 14 causes the hydraulic cylinders of the feeders 50 to retract, thereby loading next tubulars at both the lower and upper feeders 50.

The boom 32 is then lowered at full speed. The valve 17 is activated when the boom 32 reaches a point about 15 degrees above the horizontal and causes the boom to decelerate to a stop at the lower boom position. The boom clamps 36 are controlled by the valve 16 to roll over to the horizontal position as the boom 32 lowers. Simultaneously with movement of the boom 32, the lifter 40 is lowered until the valve 8 is closed, indicating that the lifter 40 is in the lower lifter position. The valve 5 opens to indicate when the boom clamps 36 are in the correct position to receive a next tubular. The sequence is now ready to begin again when the operator shifts valves P2 and P3 as described above. FIG. 5 shows the states of the various valves 1–18 and P1–P4 during the Tripping In cycle.

It is important to recognize that in the sequence described above the system 60 automatically coordinates movement of the boom 32 and the lifter 40 such that both the boom 32 and the lifter 40 are in motion at the same time. In particular, the boom 32 and the lifter 40 raise respective tubulars concurrently. In this way two lengths of tubular are in motion at the same time, and tubular handling delays are reduced or eliminated. All of this is accomplished using entirely mechanical position sensors and mechanically operated valves. The need for an explosion proof electrical system is thereby completely avoided.

Automatic Sequence For Moving Tubulars Out Of Alignment With The Bore Hole Axis (Tripping Out)

When the drilling machine 20 is used in this mode of operation the following initial conditions are provided. A tubular is held in alignment with the bore hole axis 24, and the upper joint of the tubular is firmly held in the tool 48. The body of the tubular is firmly held in the boom clamps 36 and the lower joint of the tubular has been broken out of and is clear of the tool joint of the tubular held in the slips. Both feeders 50 are deactivated by removing the fingers 56*a*, 56*b*. The upper and lower ramps 44, 46 are adjusted to slope away from the boom 32 and toward the storage device 38.

Starting in this initial state, the operator first releases the upper tool joint of the tubular from the tool 48 and hoists the top head drive assembly 28 with the attached tool 48 just enough to clear the tool joint of the tubular held in the boom clamps 36. The operator then shifts the selector valve P1 downwardly as shown in FIG. 3 and pushes the handle of valve P4 to initiate the automatic sequence. During this automatic sequence the boom 32 is lowered. The speed at which the boom is lowered is controlled by a pilot signal from the cam operated variable flow control valve 17 located adjacent the boom axis 34. Simultaneously, the cam operated valve 16 (also located at the boom axis 34) is controlled by its respective cam (not shown) to cause the boom clamps 36 to roll from the vertical to the horizontal position so that they will be in a horizontal position when the boom 32 is fully lowered.

Concurrently with the automatic sequencing described above, the operator causes the top head drive assembly 28 with the attached tool 48 to lower to the tool joint held in the slips, to close the tool 48 on this tool joint, and to hoist the tubular until its lower tool joint is clear of and two to five feet above the slips. The operator then sets the slips and uses the make up/break out wrench 30 to break out the threaded connection. The operator then uses the top head drive assembly 28 to spin out the tubular held in the tool 48 and hoists the spun out tubular clear of the joint of tubular held in the slips.

When the boom 32 is fully lowered and the boom clamps 36 are in the full horizontal position, the clamps 36 depress the lever on valve 5. The lever on valve 10 is depressed when the lifter 40 is in its upper position. When the levers on valves 5 and 10 are both depressed, the boom clamps 36 are automatically opened and the clamped tubular is released. The tubular released from the boom clamps 36 rolls via the upper ramp 36 into the lifter 40. As the tubular rolls into the lifter 40, the control lever of valve 12 is depressed, signaling that the tubular is in position for lowering the lifter 40. When valve 12 is actuated, it causes the lifter 40 to lower the tubular.

As the lifter 40 approaches its fully lowered position the tubular on the lifter 40 is transferred from the lifter 40 to the lower ramp 44. Gravity then causes the tubular to roll to the pipe storage device 38.

When the lifter 40 reaches its fully lowered position it depresses the control lever on the normally open valve 8, thereby closing the valve 8. As the tubular rolls out of the lifter 40 onto the ramp 46 enroute to the storage device 38, the tubular depresses the normally closed detented valve 15 and moves it to the open position. The opening of valve 15 resets the valve 12 and closes the normally open valve 18 which blocks the operation of the valves 16 and 17. The sequencer valve 9 is also piloted open at the same time to cause the boom 32 to rise, the boom clamps to roll over to the vertical position, and the lifter to rise.

Cam operated valves adjacent the boom axis 34 control the speed of the boom as it rises. In particular, the cam operated variable flow control valve 1 causes the boom to accelerate, hold speed and then to decelerate as the boom is raised. The cam operated normally open valve 7 causes the boom to stop at the hold position until such time as the top head drive assembly 28 is high enough in the mast 26 to depress the lever on the normally closed double detented valve 13, which permits the boom 32 to continue to rise until it reaches the vertical position aligned with the bore hole axis 24. At this point, normally closed valve 11 opens, thereby causing valves P4 and P2 to open and valve 1–18 to close. FIG. 6 shows the states of the various valves 1–18 and P1–P4 during the Tripping Out cycle.

Once again, it should be apparent that the disclosed system minimizes tubular handling time by carefully coordinating movement of the lifter and the boom, such that movement of the boom overlaps movement of the lifter.

From the foregoing description it should be apparent that an automatic sequencing system has been described which coordinates movement of a lifter and a boom to reduce or eliminate tubular handling delays. Because both the boom and the lifter are controlled in a coordinated manner such that both are in motion at the same time, the lifter cycle overlaps the boom cycle and tubular handling times are reduced. The disclosed embodiment utilizes entirely mechanical sensors and mechanically operated (including pilot pressure operated) valves. This reduces or eliminates explosion risks, and can often be manufactured in a reliable, low-cost manner which is technologically simple and which can readily be serviced and repaired by personnel without electronics backgrounds.

Of course, it should be understood that a wide range of changes and modifications can be made to the preferred embodiment described above. It is therefore intended that the foregoing detailed description be regarded as illustrative rather than limiting, and that it be understood that it is the following claims, including all equivalents, which are intended to define the scope of this invention.

We claim:

1. In an earth drilling machine of the type comprising a mast, a drive assembly movable along the mast, a boom mounted adjacent the mast to move between a lower boom position and an upper boom position, a plurality of boom clamps mounted to the boom to grip a length of down hole tubular, a tubular storage device at a lower level, and a lifter configured to move a length of down hole tubular between a lower lifter position aligned with the tubular storage device and an upper lifter position aligned with the lower boom position, the improvement comprising:

an automatic sequencing system comprising:

a plurality of position sensors responsive to position of at least the boom, the lifter, and a length of down hole tubular at selected positions;

means, responsive to the position sensors, for automatically coordinating movement of the lifter and the boom such that the boom raises a first tubular from the lower to the upper boom positions and the lifter raises a second tubular from the lower to the upper lifter positions, said boom and lifter being controlled such that movement of the boom overlaps movement of the lifter;

wherein said coordinating means controls the boom and the lifter such that upward movement of the first tubular in the boom overlaps upward movement of the second tubular in the lifter;

said position sensors comprising a plurality of pilot pressure control valves operative to control pilot pressure at least in part in response to position of the boom clamps and the lifter;

said movement coordinating means comprising a plurality of mechanically controlled hydraulic valves responsive to pilot pressure as controlled at least in part by the pilot pressure control valves to automatically open and close the boom clamps, raise and lower the lifter, and raise and lower the boom.

2. The invention of claim 1 wherein the boom clamps are rotatably mounted on the boom for movement between a horizontal and a vertical position, and wherein the drilling machine comprises lower and upper tubular feeders positioned between the tubular storage device and the lower lifter position and between the upper lifter position and the lower boom position, respectively, and wherein the invention further comprises:

means for controlling the upper and lower tubular feeders to advance the first tubular into the boom clamps and the second tubular into the lifter prior to operation of the movement coordinating means.

3. The invention of claim 2 wherein the feeder controller means comprises at least one mechanically operated hydraulic valve operative to coordinate movement of the upper and lower tubular feeders.

4. In an earth drilling machine of the type comprising a mast, a drive assembly movable along the mast, a boom mounted adjacent the mast to move between a lower boom position and an upper boom position, a plurality of boom clamps mounted to the boom to grip a length of down hole tubular, a tubular storage device at a lower level, and a lifter configured to move a length of down hole tubular between a lower lifter position aligned with the tubular storage device and an upper lifter position aligned with the lower boom position, the improvement comprising:

an automatic sequencing system comprising;

a plurality of mechanically operated position sensors responsive to position of at least the boom, the lifter, the drive assembly, and a length of down hole tubular at selected positions;

a plurality of mechanically controlled hydraulic valves, responsive to the position sensors, operative automatically to coordinate movement of the lifter and the boom such that the boom lowers a first tubular from the upper to the lower boom positions and the lifter lowers a second tubular from the upper to the lower lifter positions, said boom and lifter being controlled such that movement of the boom overlaps movement of the lifter;

said plurality of mechanically operated position sensors comprising a plurality of pilot pressure control valves operative to control pilot pressure at least in part in response to position of the boom clamps and the lifter;

said plurality of mechanically controlled hydraulic valves responsive to pilot pressure as controlled at least in part by the pilot pressure control valves to automatically open and close the boom clamps, raise and lower the lifter, and raise and lower the boom.

5. The invention of claim 4 wherein the earth drilling machine further comprises means for rotatably mounting the boom clamps to the boom, and wherein the plurality of mechanically controlled hydraulic valves comprise a valve responsive to pilot pressure to automatically rotate the boom clamps.

* * * * *

UNITED STATES PATENT AND TRADEMARK OFFICE

CERTIFICATE OF CORRECTION

PATENT NO. : 5,294,228
DATED : March 15, 1994
INVENTOR(S) : Clyde A. Willis et al.

It is certified that error appears in the above-indentified patent and that said Letters Patent is hereby corrected as shown below:

In column 1, lines 44-45 delete "explosion proof electric system can be avoided to the".

In column 1, line 46 after "an" insert --explosion proof electric system can be avoided to the--.

In column 10, line 3 delete "1-18" and substitute --15--.

Signed and Sealed this

Eighteenth Day of October, 1994

*Attest:*

*Attesting Officer*

Bruce Lehman

BRUCE LEHMAN

*Commissioner of Patents and Trademarks*